US010463550B1

(12) United States Patent
Shekarchi

(10) Patent No.: US 10,463,550 B1
(45) Date of Patent: Nov. 5, 2019

(54) BED HAIR-WASHING STATION

(71) Applicant: Kayvan Shekarchi, Toronto (CA)

(72) Inventor: Kayvan Shekarchi, Toronto (CA)

( * ) Notice: Subject to any disclaimer, the term of this patent is extended or adjusted under 35 U.S.C. 154(b) by 0 days.

(21) Appl. No.: 16/114,293

(22) Filed: Aug. 28, 2018

(51) Int. Cl.

| | |
|---|---|
| ***A61G 7/00*** | (2006.01) |
| ***A45D 19/04*** | (2006.01) |
| ***A45D 19/08*** | (2006.01) |
| ***E03C 1/22*** | (2006.01) |
| ***A45D 19/12*** | (2006.01) |
| *A45D 19/00* | (2006.01) |

(52) U.S. Cl.
CPC ..... *A61G 7/0005* (2013.01); *A45D 19/04* (2013.01); *A45D 19/08* (2013.01); *A45D 19/12* (2013.01); *E03C 1/22* (2013.01); *A45D 2019/005* (2013.01); *A61G 2200/32* (2013.01)

(58) Field of Classification Search
CPC ..... A45D 19/00; A45D 19/02; A45D 19/04; A45D 19/06–12; A45D 2019/0041–0091; A61G 7/0005; A61H 35/008; A47K 1/02
USPC ..... 4/516
See application file for complete search history.

(56) References Cited

U.S. PATENT DOCUMENTS 1,855,864 A * 4/1932 Mjaaland ..... A47K 1/05 4/519
2,514,584 A 7/1950 Muth
2,818,585 A * 1/1958 Campbell ..... A45D 19/04 297/182
3,407,411 A * 10/1968 Stevens ..... A61G 7/0005 4/561.1
3,465,370 A 9/1969 Chernick
3,678,943 A * 7/1972 Noel ..... A45D 19/04 132/212
3,733,620 A 5/1973 Glintz
3,816,858 A 6/1974 Martin
4,419,774 A 12/1983 Hajek
4,935,971 A 6/1990 Dunn
4,998,302 A * 3/1991 Silva ..... A45D 19/04 4/516
5,269,030 A * 12/1993 Pahno ..... A61G 7/0005 4/480
D398,075 S 9/1998 Book
6,711,757 B2 * 3/2004 Peck ..... A47K 1/02 4/516
7,234,176 B1 6/2007 Chiu
(Continued)

FOREIGN PATENT DOCUMENTS

WO WO0121127 * 3/2001 ..... A61G 7/00

*Primary Examiner* — Erin Deery
*Assistant Examiner* — Nicholas A Ros
(74) *Attorney, Agent, or Firm* — Kyle A. Fletcher, Esq.

(57) ABSTRACT

The bed hair-washing station is configured for use with a bedridden patient. The bed hair-washing station is configured for use in washing the hair of the patient. The bed hair-washing station is a portable structure that rolls to the bed of the patient. The bed hair-washing station comprises a basin, a source system, a drain system, and a cart. The basin, the source system, and the drain system attach to the cart. The basin receives and controls the fluid flow required to wash the hair of the patient. The source water provides fresh water for use in washing the hair of the patient. The drain system removes and stores the gray water generated by washing the hair of the patient. The cart is a wheeled structure that allows the bed hair-washing station to roll to the patient.

16 Claims, 6 Drawing Sheets

(56) References Cited

U.S. PATENT DOCUMENTS

| | | | | |
|---|---|---|---|---|
| 7,469,430 | B2 * | 12/2008 | Thies | A45D 19/04 4/516 |
| 2003/0019031 | A1 * | 1/2003 | Mosis | A47K 1/02 4/625 |
| 2004/0068824 | A1 * | 4/2004 | Gardner | A61G 7/0005 15/322 |
| 2007/0044225 | A1 * | 3/2007 | Palacios | A45D 19/04 4/516 |
| 2011/0191954 | A1 * | 8/2011 | Fajerstein | A45D 19/04 4/612 |

* cited by examiner

BED HAIR-WASHING STATION

CROSS REFERENCES TO RELATED APPLICATIONS

Not Applicable

STATEMENT REGARDING FEDERALLY SPONSORED RESEARCH

Not Applicable REFERENCE TO APPENDIX Not Applicable BACKGROUND OF THE INVENTION

FIELD OF THE INVENTION

The present invention relates to the field of personal and domestic articles including hairdressing equipment, more specifically, a device for washing hair in the form of a bowl or open container. (A45D19/06)

SUMMARY OF INVENTION

The bed hair-washing station is configured for use with a bedridden patient. The bed hair-washing station is configured for use in washing the hair of the patient. The bed hair-washing station is a portable structure that rolls to the bed of the patient. The bed hair-washing station comprises a basin, a source system, a drain system, and a cart. The basin, the source system, and the drain system attach to the cart. The basin receives and controls the fluid flow required to wash the hair of the patient. The source water provides fresh water for use in washing the hair of the patient. The drain system removes and stores the gray water generated by washing the hair of the patient. The cart is a wheeled structure that allows the bed hair-washing station to roll to the patient.

It shall be noted that an object of the invention would be to have an embodiment that may heat the fresh water to a desired temperature as well as an embodiment that does not heat the fresh water.

These together with additional objects, features and advantages of the bed hair-washing station will be readily apparent to those of ordinary skill in the art upon reading the following detailed description of the presently preferred, but nonetheless illustrative, embodiments when taken in conjunction with the accompanying drawings.

In this respect, before explaining the current embodiments of the bed hair-washing station in detail, it is to be understood that the bed hair-washing station is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bed hair-washing station.

It is therefore important that the claims be regarded as including such equivalent construction insofar as they do not depart from the spirit and scope of the bed hair-washing station. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
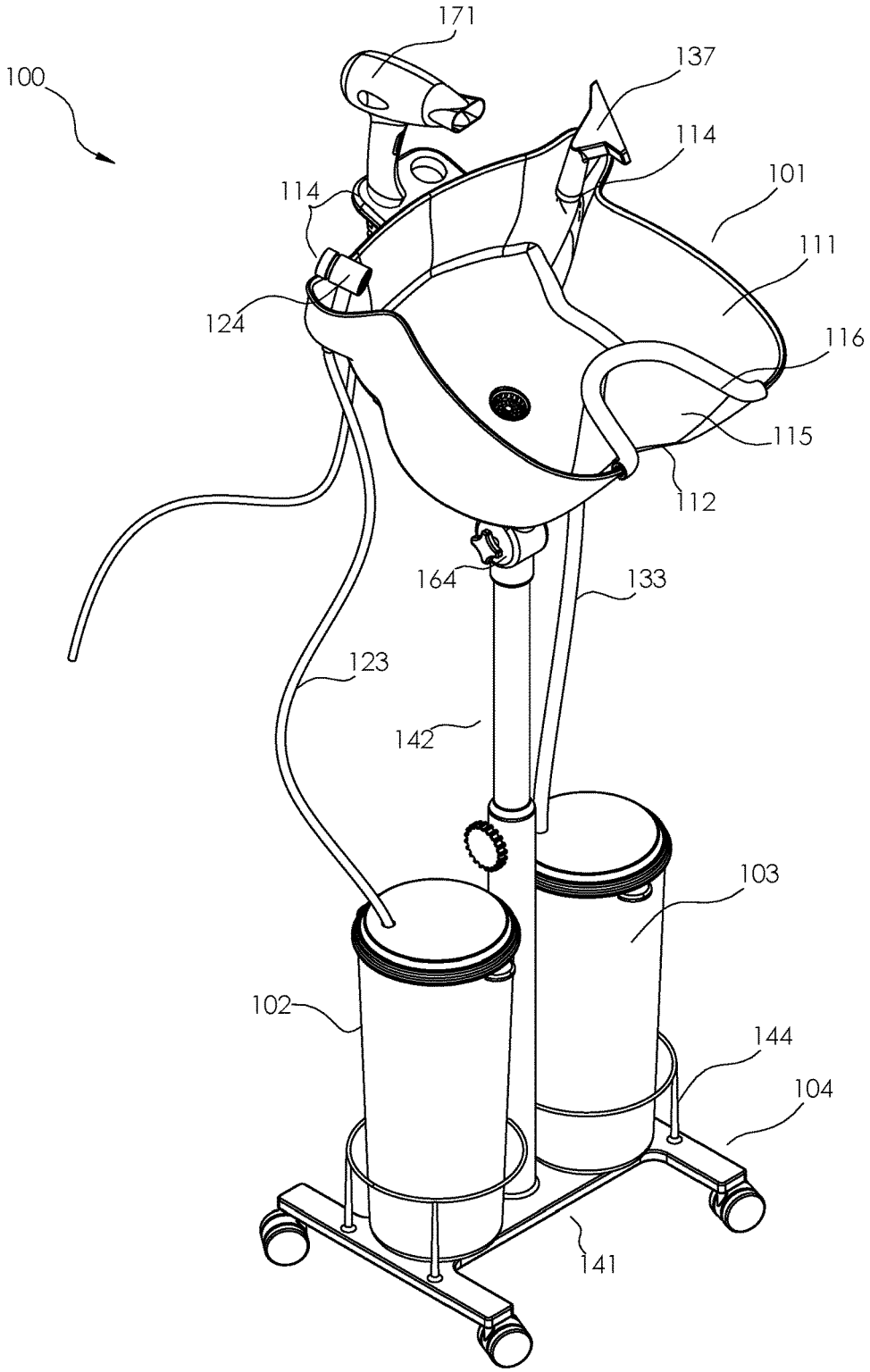
FIG. 1 is a perspective view of an embodiment of the disclosure.
Figure 2:
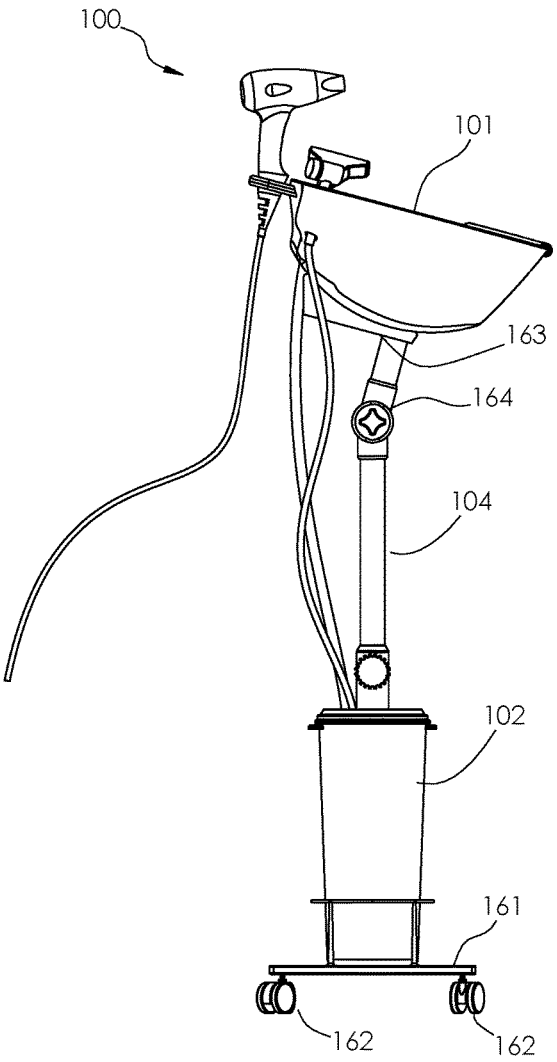
FIG. 2 is a side view of an embodiment of the disclosure.
Figure 3:
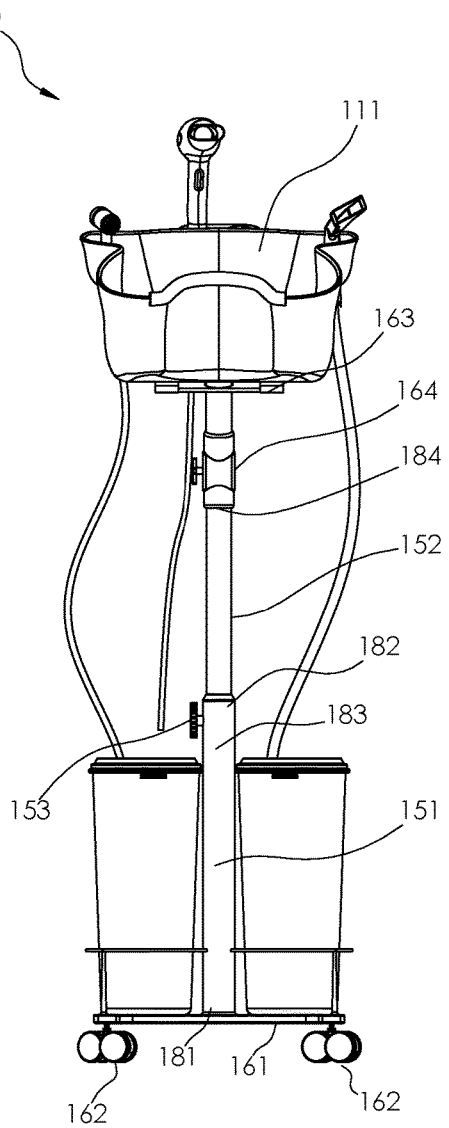
FIG. 3 is a front view of an embodiment of the disclosure.
Figure 4:
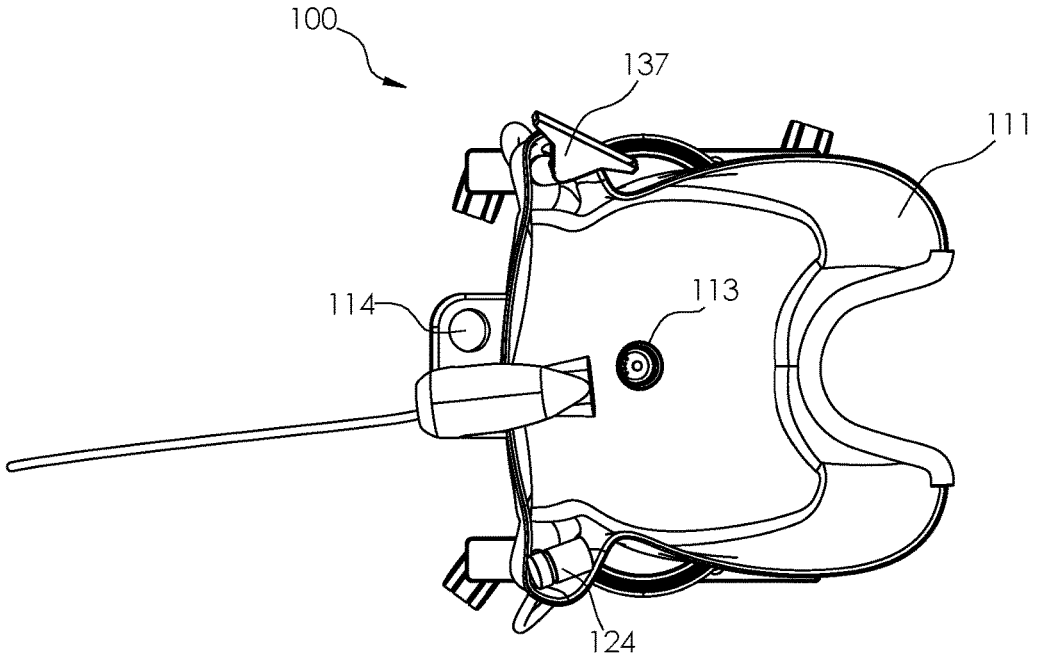
FIG. 4 is a top view of an embodiment of the disclosure.
Figure 5:
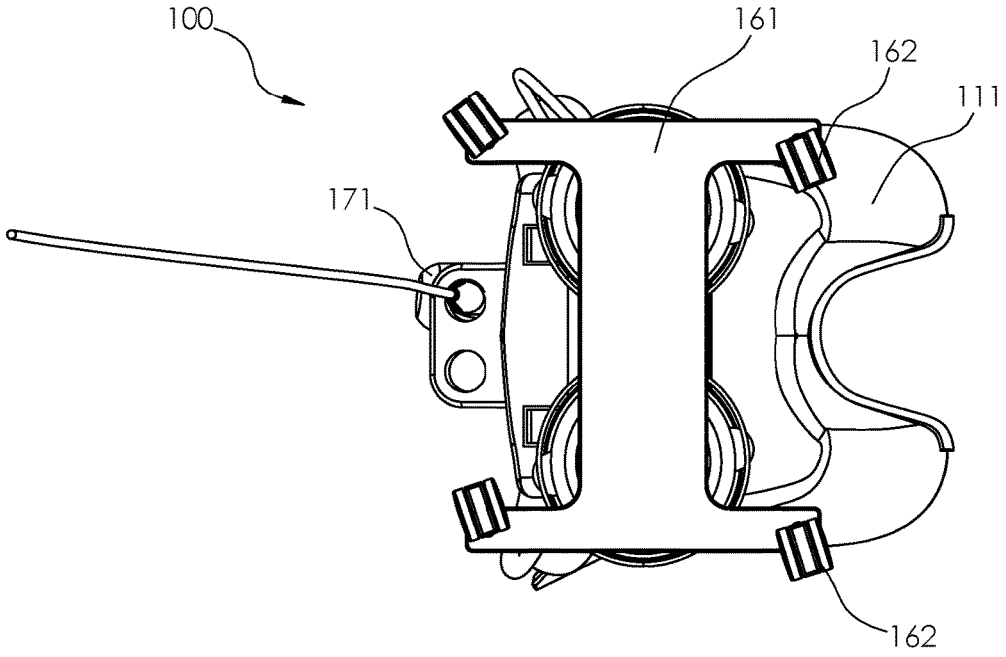
FIG. 5 is a bottom view of an embodiment of the disclosure.
Figure 6:
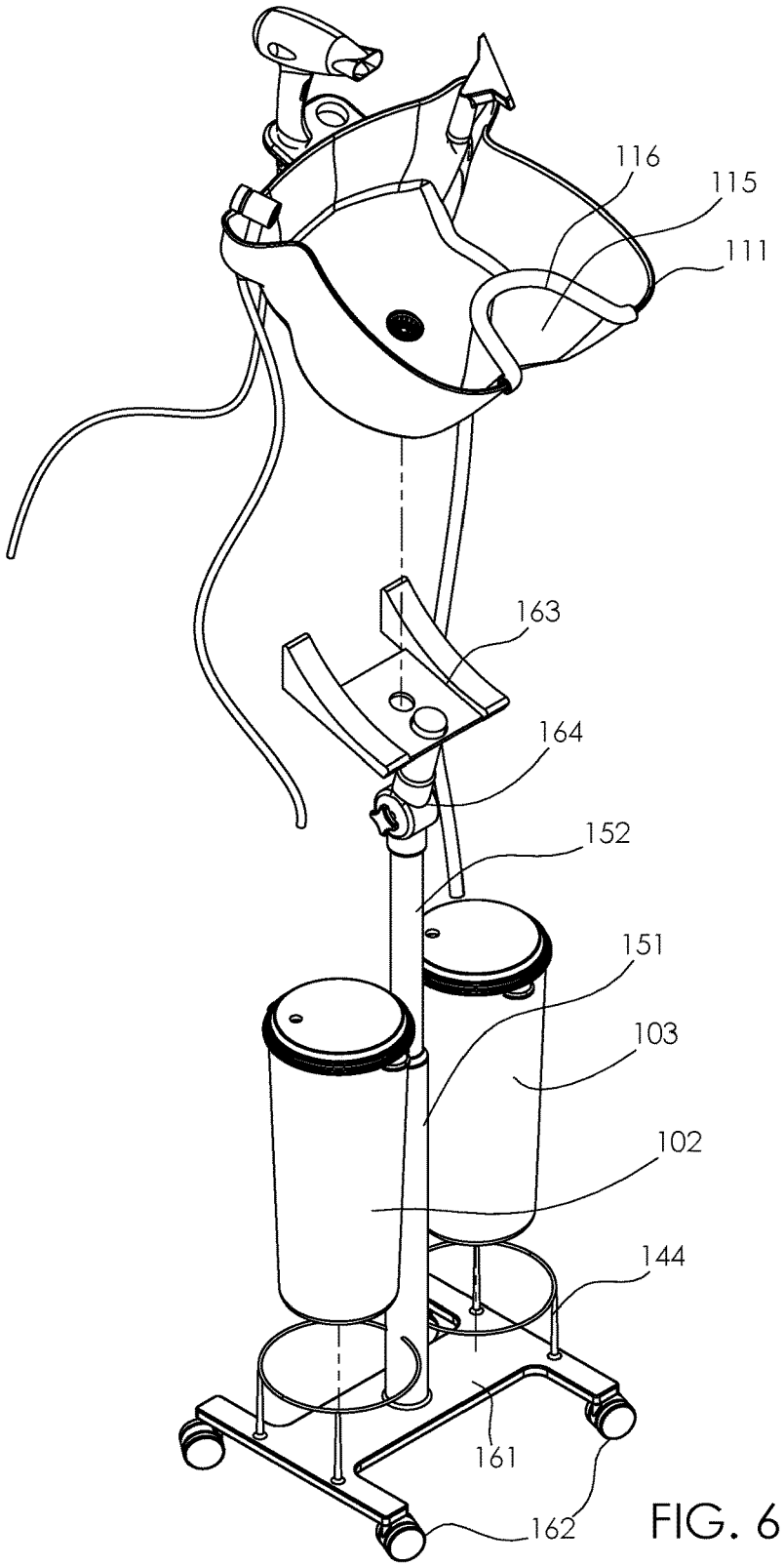
FIG. 6 is an exploded view of an embodiment of the disclosure.
Figure 7:
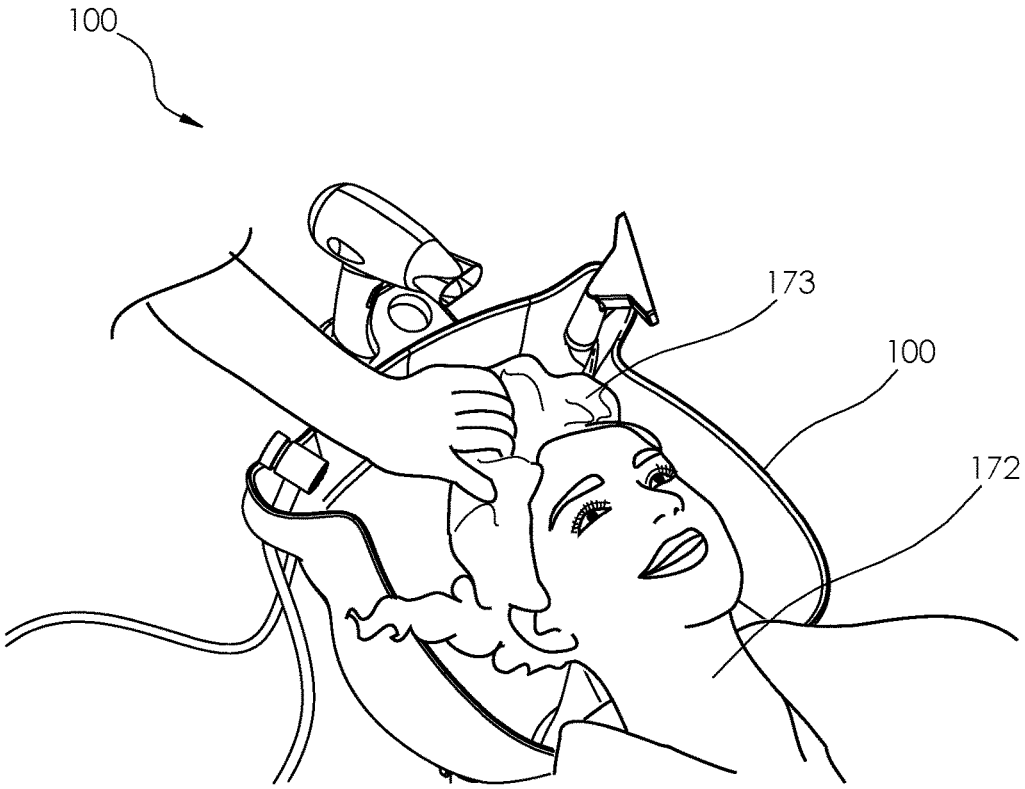
FIG. 7 is a detail view of an embodiment of the disclosure.
Figure 8:
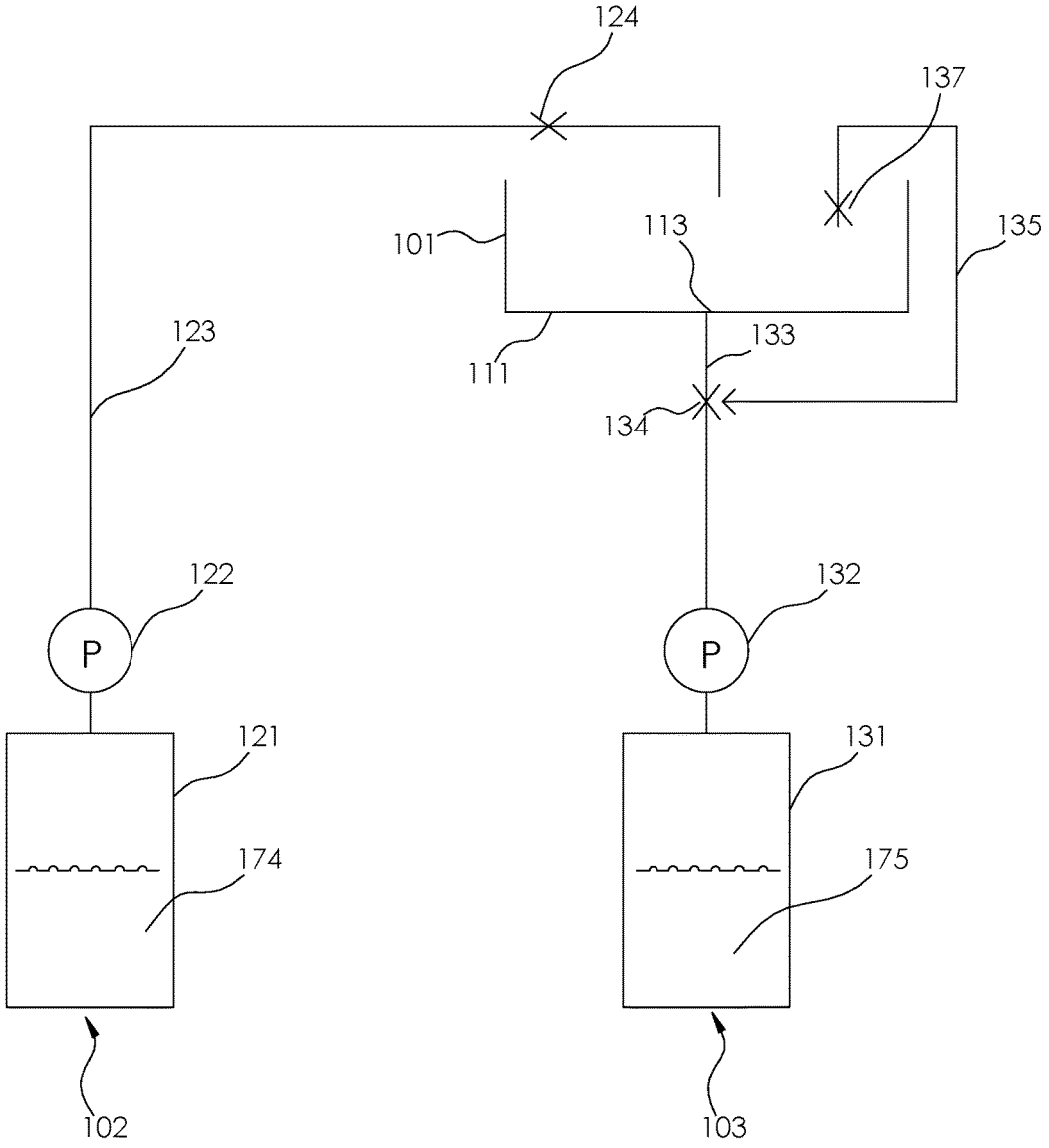
FIG. 8 is a block diagram of an embodiment of the disclosure.

Detailed reference will now be made to one or more potential embodiments of the disclosure, which are illustrated in FIGS. 1 through 8.

The bed hair-washing station 100 (hereinafter invention) is configured for use with a bedridden patient 172. The invention 100 is configured for use in washing the hair 173 of the patient 172. The invention 100 is a portable structure that rolls to the bed of the patient 172. The invention 100 comprises a basin 101, a source system 102, a drain system 103, and a cart 104. The basin 101, the source system 102, and the drain system 103 attach to the cart 104. The basin 101 receives and controls the fluid flow required to wash the hair 173 of the patient 172. The source water provides fresh water 174 for use in washing the hair 173 of the patient 172. The drain system 103 removes and stores the gray water 175 generated by washing the hair 173 of the patient 172. The cart 104 is a wheeled structure that rolls to the patient 172.

The basin 101 is a containment structure. The basin 101 is placed underneath the hair 173 of the patient 172 such that the gray water 175 generated by the hair 173 washing process is captured for processing by the drain system 103. The basin 101 comprises a sink 111, a neck support 112, a drain 113, and a plurality of nozzle mounts 114.

The sink 111 is an open containment structure. The sink 111 is positioned beneath the hair 173 of the patient 172 such that the sink 111 captures any defluxion of gray water 175 from the hair 173 of the patient 172.

The neck support 112 is a structure formed in the sink 111. The patient 172 places the neck in the neck support 112 such that: a) the neck support 112 forms a partial circumvolution around the neck of the patient 172; and, b) the hair 173 of the patient 172 is in a superior position directly over the sink 111. The neck support 112 comprises a trough 115 and a cushion 116. The trough 115 is a hyoid shaped channel sized to receive the neck of the patient 172. The trough 115 forms a channel which partially circumvolutes the neck of the patient 172. The cushion 116 is a pad that lines the surfaces of the trough 115 that come in contact with the patient 172. The cushion 116 protects the patient 172 from injury.

The drain 113 is a plumbing fitting. The drain 113 installs in the sink 111. The drain 113 forms a fluidic connection between the basin 101 and the drain system 103 such that the gray water 175 will flow from the sink 111 into the drain system 103. The use of a drain 113 with a sink 111 is well-known and documented in the plumbing arts.

Each of the plurality of nozzle mounts 114 is a bracket. Each of the plurality of nozzle mounts 114 stores an accessory associated with the washing of the hair 173 of the patient 172. The hair dryer 171 is a well-known and documented item of hairdressing equipment. A nozzle mount selected from the plurality of nozzle mounts 114 is configured to receive and store the hair dryer 171.

The source system 102 is a source of fresh water 174. The source system 102 delivers the fresh water 174 under pressure to the basin 101 such that the fresh water 174 is available to wash and rinse the hair 173 of the patient 172. The source system 102 comprises a source tank 121, a source pump 122, and a source hose 123.

The source tank 121 is an enclosed hollow prism-shaped structure. The source tank 121 stores the fresh water 174 used to wash the hair 173 of the patient 172. The source pump 122 is a commercially available submersible pump. The source pump 122 mounts in the source tank 121. The source pump 122 pumps the fresh water 174 from the source tank 121 through the source hose 123 to the source nozzle 124.

The source hose 123 forms a fluidic connection that transports the fresh water 174 from the source pump 122 to the source nozzle 124. The span of the source hose 123 is selected such that the source nozzle 124 can be held and manipulated above the sink 111.

The source nozzle 124 is a manually operated valve. The source nozzle 124 is a commercially available device. The source hose 123 further comprises a source nozzle 124. The source nozzle 124 terminates the end of the source hose 123 that is distal from the source pump 122. The source nozzle 124 controls the flow of fresh water 174 into the hair 173 of the patient 172 during the hair 173 washing process. The source nozzle 124 is formed as a spray nozzle that sprays the fresh water 174 as droplets suitable for use in washing the hair 173 of the patient 172.

The drain system 103 handles the gray water 175 generated while washing the hair 173 of the patient 172. The drain system 103 pumps the gray water 175 away from the basin 101. The drain system 103 comprises a drain tank 131, a drain pump 132, and a primary drain hose 133.

The drain tank 131 is an enclosed hollow prism-shaped structure. The drain tank 131 receives and stores the gray water 175 generated by washing the hair 173 of the patient 172.

The drain pump 132 is a commercially available submersible pump. The drain pump 132 mounts in the drain tank 131. The drain pump 132 pumps the gray water 175 from the drain 113 through the primary drain hose 133 into the drain tank 131.

The primary drain hose 133 forms a fluidic connection that transports the gray water 175 from the drain 113 to the drain pump 132. The span of the primary drain hose 133 is selected such that the telescopic stanchion 142 can be raised and lowered to adjust the elevation of the sink 111. The primary drain hose 133 attaches to the drain 113. The drain 113 terminates the end of the primary drain hose 133 that is distal from the drain pump 132.

In a second potential embodiment of the disclosure, the drain system 103 further comprises a suction device used to draw gray water 175 directly away from the hair 173 of the patient 172. In this scenario, the drain system 103 further comprises a drain valve 134 and a secondary drain hose 135. The secondary drain hose 135 further comprises a secondary drain nozzle 137.

The drain valve 134 is a three port valve. The drain valve 134 adjusts the routing of the flow of the gray water 175 between the sink 111 and the drain pump 132. The first flow path provided by the drain valve 134 is the flow of the gray water 175 between the drain 113 and the drain pump 132 through the primary drain hose 133. The drain valve 134 installs in the primary drain hose 133 such that the secondary drain hose 135 and the secondary drain nozzle 137 forms a second flow path for the gray water 175.

The drain valve 134 selects between the first flow path and the second flow path of the gray water 175. The drain valve 134 routes the gray water 175 received from the drain 113 directly to the drain pump 132. The drain valve 134 routes the gray water 175 received from the secondary drain hose 135 directly to the drain pump 132.

When the second flow path of the gray water 175 is selected, the drain pump 132 creates a vacuum within the secondary drain hose 135 which creates a suction at the secondary drain nozzle 137. The suction at the secondary drain nozzle 137 draws the gray water 175 away from the hair 173 of the patient 172 directly into the secondary drain hose 135 such that the gray water 175 flows directly to the drain valve 134.

The cart 104 is a wheeled vehicle that allows the basin 101, the source system 102, and the drain system 103 to roll to the patient 172. The cart 104 comprises a pedestal 141, a telescopic stanchion 142, a basin 101 mount 143, and a plurality of tank cages 144.

The pedestal 141 is the inferior structure of the cart 104. The pedestal 141 transfers the load path of the invention 100 to the supporting surface on which the invention 100 rests. The pedestal 141 comprises a horizontal platform 161 and a plurality of casters 162.

The telescopic stanchion 142 is a vertical support structure. The telescopic stanchion 142 is an extension apparatus that adjusts the elevation of the basin 101 above the supporting surface. The telescopic stanchion 142 is a telescopic structure. The telescopic stanchion 142 attaches to the pedestal 141 such that the telescopic stanchion 142 projects vertically away from the pedestal 141. The telescopic stanchion 142 comprises a first arm 151, a second arm 152, and a detent 153. The first arm 151 is further defined with a first end 181 and a second end 182. The second arm 152 is further defined with a third end 183 and a fourth end 184.

The detent 153 connects the second arm 152 to the first arm 151. The first arm 151 is a hollow first prism that is further defined with an inner dimension. The second arm 152 is a second prism that is further defined with an outer dimension. The first arm 151 and the second arm 152 are geometrically similar. The outer dimension of the second arm 152 is less than the inner dimension of the first arm 151 such that the second arm 152 can be inserted into the first arm 151 in a telescopic manner. This telescopic arrangement of the telescopic stanchion 142 allows the length of the telescopic stanchion 142 to be adjusted by adjusting the relative position of the second arm 152 within the first arm 151. The position of the second arm 152 relative to the first arm 151 is held in position using the detent 153. The detent 153 is a mechanical device that connects and secures the first arm 151 to the second arm 152.

The basin 101 mount 143 is a mechanical structure. The basin 101 mount 143 attaches to the free end of the telescopic stanchion 142. The basin 101 mount 143 attaches the basin 101 to the cart 104. The basin 101 mount 143 comprises a basin 101 dock 163 and a universal joint 164.

The horizontal platform 161 is a horizontal plate structure. The horizontal platform 161 supports the plurality of tank cages 144. The plurality of tank cages 144 mount on the superior surface of the horizontal platform 161. Each of the plurality of casters 162 is a commercially available caster. The plurality of casters 162 allow the invention 100 to roll into position.

The first end 181 is the end of the first arm 151 that attaches to the superior surface of the horizontal platform 161. The first end 181 attaches to the horizontal platform 161 such that the first arm 151 projects perpendicularly away from the horizontal platform 161. The second end 182 is the end of the first arm 151 that is distal from the first end 181. The second end 182 receives the third end 183 of the second arm 152. The third end 183 is the end of the second arm 152 that is distal from the fourth end 184. The third end 183 of the second arm 152 inserts into the second end 182 of the first arm 151. The fourth end 184 forms the superior end of the telescopic stanchion 142. The fourth end 184 attaches to the universal joint 164 of the cart 104.

The basin 101 dock 163 is a mechanical structure that permanently attaches the basin 101 to the universal joint 164. The universal joint 164 is a locking universal joint 164. The universal joint 164 attaches the basin 101 dock 163 to the pedestal 141. The universal joint 164 allows for the adjustment of the cant of the basin 101 relative to the force of gravity. Each of the plurality of tank cages 144 is an openwork cage. The plurality of tank cages 144 attach to the pedestal 141. The construction of the plurality of tank cages 144 is such that each cage contained within the plurality of tank cages 144 is sized to receive and store a tank selected from the group consisting of the source tank 121 and the drain tank 131. Each of the plurality of tank cages 144 stores the selected tank such that the selected tank will not shift while the invention 100 rolls to the patient 172.

The following definitions were used in this disclosure:

Basin: As used in this disclosure, a basin is an open container configured to receive a fluid and manage a fluid.

Bedridden: As used in this disclosure, bedridden refers to a condition of a patient that confines a patient to a bed.

Bracket: As used in this disclosure, a bracket is a mechanical structure that attaches a second structure to a first structure such that the load path of the second structure is fully transferred to the first structure.

Cage: As used in this disclosure, a cage is an openwork structure that defines an interior volume within which an object may be contained.

Cant: As used in this disclosure, a cant is an angular deviation from one or more reference lines (or planes) such as a vertical line (or plane) or a horizontal line (or plane).

Cart: As used in this disclosure, a cart is small vehicle intended to be moved by a person.

Caster: As used in this disclosure, a caster is a wheel mounted on a swivel that allows the wheel to adjust, or swivel, the direction of rotation of the wheel to the direction of motion desired for the wheel.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Circumvolution: As used in this disclosure, circumvolution refers to the wrapping of a second object around a first object.

Correspond: As used in this disclosure, the term correspond is used as a comparison between two or more objects wherein one or more properties shared by the two or more objects match, agree, or align within acceptable manufacturing tolerances.

Cushion: As used in this disclosure a cushion is a structure formed from a pad that is used to prevent injury or damage to a person or object.

Defluxion: As used in this disclosure, defluxion refers to a liquid flowing in the direction of the force of gravity.

Detent: As used in this disclosure, a detent is a device for positioning and holding a first object relative to a second object such that the position of the first object relative to the second object is adjustable.

Dock: As used in this disclosure, a dock refers to a mount intended to secure a component to a structure.

Drain: As used in this disclosure, a drain is a fitting that is used to remove a fluid from a device.

Elevation: As used in this disclosure, elevation refers to the span of the distance between a horizontal surface and a supporting surface as measured in the direction opposite to the force of gravity.

Extension Apparatus: As used in this disclosure, an extension apparatus is a mechanical structure that is used to extend the span of the distance between any two objects or the reach of a first object towards a second object.

Fitting: As used in this disclosure, a fitting is a component that is attached to a first object. The fitting is used to form a fluidic connection between the first object and a second object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Ground: As used in this disclosure, the ground is a solid supporting surface formed by the Earth. The term level ground means that the supporting surface formed by the ground is roughly perpendicular to the force of gravity.

Gray Water: As used in this disclosure, gray water to domestically generated wastewater that is no longer suitable for consumption.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Hose: As used in this disclosure, a hose is a flexible hollow prism-shaped device that is used for transporting liquids and gases. When referring to a hose in this disclosure, the terms inner diameter and outer diameter are used as they would be used by those skilled in the plumbing arts.

Inferior: As used in this disclosure, the term inferior refers to a directional reference that is parallel to and in the same direction as the force of gravity when an object is positioned or used normally.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Mount: As used in this disclosure, a mount is a mechanical structure that attaches or incorporates an object into a load path.

Nozzle: As used in this disclosure, a nozzle is a device that receives fluid under pressure and releases the fluid in a controlled manner into an environment.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Openwork: As used in this disclosure, the term open work is used to describe a structure, often a surface, which is formed with openings that allow for visibility and fluid flow through the structure. Wrought work and meshes are forms of openwork.

Pad: As used in this disclosure, a pad is a mass of soft material used as a filling or for protection against damage or injury. Commonly used padding materials include, but are not limited to, polyurethane foam, silicone, a polyester fill often referred to as fiberfill or polystyrene beads often referred to as stuffing beans or as bean bag chair beans.

Patient: As used in this disclosure, a patient is a person who is designated to receive a medical treatment, therapy or service. The term patient may be extended to an animal when used within the context of the animal receiving veterinary treatment or services Pedestal: As used in this disclosure, a pedestal is an intermediary load bearing structure that that transfers a load path between a supporting surface and an object, structure, or load.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pump: As used in this disclosure, a pump is a mechanical device that uses suction or pressure to raise or move fluids, compress fluids, or force a fluid into an inflatable object. Within this disclosure, a compressor refers to a pump dedicated to compressing a fluid or placing a fluid under pressure.

Roll: As used in this disclosure, the term roll refers to the motion of an object that is facilitated by the rotation of one or more wheels or casters.

Spray Nozzle: As used in this disclosure, a spray nozzle is a device that receives liquid under pressure and disperses that liquid into the atmosphere as a spray.

Stanchion: As used in this disclosure, a stanchion refers to a vertical pole, post, or support.

Superior: As used in this disclosure, the term superior refers to a directional reference that is parallel to and in the opposite direction of the force of gravity.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Tank: As used in this disclosure, a tank is an enclosed hollow structure used to store a fluid.

Telescopic: As used in this disclosure, telescopic is an adjective that describes an object made of sections that fit or slide into each other such that the object can be made longer or shorter by adjusting the relative positions of the sections.

Therapeutic: As used in this disclosure, therapeutic is an adjective that refers to a medical, ameliorative, or hygienic substance, process, or procedure.

Trough: As used in this disclosure, a trough refers to a three-sided structure comprising a cross-plate, a first plate, and a second plate. In a trough, the first plate and the second plate project away from the cross-plate: 1) in the same direction; 2) at a roughly perpendicular angle to the cross-beam, and, 3) the span of the length of the first plate roughly equals the span of the length of the second plate. Troughs generally have a hyoid shaped appearance. A gutter is an example of a trough.

Universal Joint: As used in this disclosure, a universal joint is a method of joining a first shaft to a second shaft such that the center axis of the first shaft and is offset from the center axis of the second shaft. When a universal joint comprises a locking mechanism, a universal joint can further be used to lock the angle between the first shaft and the second shaft into a fixed position. Universal joints are often used to transfer rotation from the first shaft to rotate the second shaft.

Vacuum: As used in this disclosure, vacuum is used to describe a first space that contains gas at a reduced gas pressure relative to the gas pressure of a second space. If the first space and the second space are connected together, this pressure differential will cause gas from the second space to move towards the first space until the pressure differential is eliminated.

Valve: As used in this disclosure, a valve is a device that is used to control the flow of a fluid (gas or liquid) through a pipe.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A device for washing hair comprising:
- a basin, a source system, a drain system, and a cart;
- wherein the basin, the source system, and the drain system attach to the cart;
- wherein the device for washing hair is configured for use with a patient;
- wherein the device for washing hair is configured for use in washing the hair of the patient;
- wherein the device for washing hair is a portable structure that rolls to the patient;
- wherein the basin receives and controls the fluid flow required to wash the hair of the patient;
- wherein a source water provides fresh water for use in washing the hair of the patient;
- wherein the drain system removes and stores gray water generated by washing the hair of the patient;
- wherein the cart is a wheeled structure;
- wherein the basin comprises a sink, a neck support, a drain, and a plurality of nozzle mounts;
- wherein the neck support is formed in the sink;
- wherein the plurality of nozzle mounts attach to the sink;
- wherein the drain installs in the sink;
- wherein each of the plurality of nozzle mounts is a bracket;
- wherein each of the plurality of nozzle mounts stores an accessory associated with the washing of the hair of the patient;
- wherein the drain system comprises a drain tank, a drain pump, and a primary drain hose;
- wherein the drain tank is an enclosed hollow prism-shaped structure;
- wherein the drain tank receives and stores the gray water;
- wherein the drain pump pumps the gray water from the drain through the primary drain hose into the drain tank;
- wherein the primary drain hose forms a fluidic connection that transports the gray water from the drain to the drain pump;
- wherein the drain system further comprises a drain valve and a secondary drain hose;
- wherein the drain valve installs in the primary drain hose;
- wherein the secondary drain hose attaches to the drain valve;
- wherein the drain valve is a three port valve;
- wherein the drain valve adjusts the routing of the flow of the gray water between the sink and the drain pump;
- wherein the drain valve routes the gray water received from the drain directly to the drain pump;
- wherein the drain valve routes the gray water received from the secondary drain hose directly to the drain pump.

2. The device for washing hair according to claim 1
- wherein the basin is a containment structure;
- wherein the basin is placed underneath the hair of the patient;
- wherein the basin captures the gray water.

3. The device for washing hair according to claim 2
- wherein the source system delivers the fresh water under pressure to the basin such that the fresh water is available to wash and rinse the hair of the patient;
- wherein the drain system receives the generated gray water;
- wherein the drain system pumps the gray water away from the basin.

4. The device for washing hair according to claim 3
- wherein the sink is a containment structure;
- wherein the sink is an open structure;
- wherein the sink captures the defluxion of gray water from the hair of the patient.

5. The device for washing hair according to claim 4
- wherein the neck support comprises a trough and a cushion;
- wherein the trough is a hyoid shaped channel sized to receive the neck of the patient;
- wherein the cushion is a pad that lines the surfaces of the trough that come in contact with the patient.

6. The device for washing hair according to claim 5
- wherein the drain is a plumbing fitting;
- wherein the drain forms a fluidic connection between the basin and the drain system such that the gray water will flow from the sink into the drain system.

7. The device for washing hair according to claim 6
- wherein the source system comprises a source tank, a source pump, and a source hose;

wherein the source tank is an enclosed hollow prism-shaped structure;

wherein the source hose forms a fluidic connection that transports the fresh water from the source pump to a source nozzle;

wherein the source tank stores the fresh water;

wherein the source pump pumps the fresh water from the source tank through the source hose to the source nozzle.

8. The device for washing hair according to claim 7 wherein the source pump is a submersible pump;

wherein the source pump mounts in the source tank.

9. The device for washing hair according to claim 8 wherein the source hose further comprises a source nozzle;

wherein the source nozzle is a manually operated valve;

wherein the source nozzle terminates the end of the source hose that is distal from the source pump;

wherein the source nozzle controls the flow of fresh water into the hair of the patient during the hair washing process.

10. The device for washing hair according to claim 9 wherein the drain pump is a submersible pump;

wherein the drain pump mounts in the drain tank.

11. The device for washing hair according to claim 10 wherein the secondary drain hose further comprises a secondary drain nozzle;

wherein the drain pump creates a vacuum within the secondary drain hose which creates a suction at the secondary drain nozzle;

wherein the suction at the secondary drain nozzle draws the gray water away from the hair of the patient directly into the secondary drain hose.

12. The device for washing hair according to claim 11 wherein the cart comprises a pedestal, a telescopic stanchion, a basin mount, and a plurality of tank cages;

wherein the plurality of tank cages attach to the pedestal;

wherein the telescopic stanchion attaches the basin mount to the pedestal;

wherein the telescopic stanchion is a vertical support structure;

wherein the telescopic stanchion is an extension apparatus that adjusts the elevation of the basin above the supporting surface;

wherein the telescopic stanchion attaches to the pedestal such that the telescopic stanchion projects vertically away from the pedestal.

13. The device for washing hair according to claim 12 wherein the pedestal comprises a horizontal platform and a plurality of casters;

wherein the horizontal platform comprises an inferior surface and a superior surface;

wherein the plurality of casters attach to the inferior surface of the horizontal platform;

wherein the horizontal platform is a horizontal plate structure;

wherein the horizontal platform supports the plurality of tank cages;

wherein the plurality of tank cages mount on the superior surface of the horizontal platform;

wherein each of the plurality of tank cages is an openwork cage;

wherein the construction of the plurality of tank cages is such that each cage contained within the plurality of tank cages is sized to receive and store a tank selected from the group consisting of the source tank and the drain tank;

wherein each of the plurality of tank cages stores the selected tank such that the selected tank will not shift.

14. The device for washing hair according to claim 13 wherein the telescopic stanchion comprises a first arm, a second arm, and a detent;

wherein the first arm is further defined with a first end and a second end;

wherein the second arm is further defined with a third end and a fourth end;

wherein the detent is a mechanical device that connects and secures the first arm to the second arm;

wherein the first arm is a hollow first prism that is further defined with an inner dimension;

wherein the second arm is a second prism that is further defined with an outer dimension;

wherein the first arm and the second arm are geometrically similar;

wherein the outer dimension of the second arm is less than the inner dimension of the first arm such that the second arm inserts into the first arm.

15. The device for washing hair according to claim 14 wherein the basin mount attaches the basin to the cart;

wherein the basin mount comprises a basin dock and a universal joint;

wherein the basin dock is a mechanical structure that permanently attaches the basin to the free end of the universal joint;

wherein the universal joint is a locking universal joint;

wherein the universal joint allows for the adjustment of the cant of the basin relative to the force of gravity.

16. The device for washing hair according to claim 15 wherein the first end is the end of the first arm that attaches to the superior surface of the horizontal platform;

wherein the first end attaches to the horizontal platform such that the first arm projects perpendicularly away from the horizontal platform;

wherein the second end is the end of the first arm that is distal from the first end;

wherein the second end receives the third end of the second arm;

wherein the third end is the end of the second arm that is distal from the fourth end;

wherein the third end of the second arm inserts into the second end of the first arm;

wherein the fourth end forms the superior end of the telescopic stanchion;

wherein the fourth end attaches to the universal joint of the cart.

* * * * *